US011787510B2

(12) United States Patent
Hutchins

(10) Patent No.: US 11,787,510 B2
(45) Date of Patent: Oct. 17, 2023

(54) ADJUSTABLE BOAT CONSOLE

(71) Applicant: Jonathan Hutchins, LaGrange, GA (US)

(72) Inventor: Jonathan Hutchins, LaGrange, GA (US)

( * ) Notice: Subject to any disclaimer, the term of this patent is extended or adjusted under 35 U.S.C. 154(b) by 345 days.

(21) Appl. No.: 17/227,969

(22) Filed: Apr. 12, 2021

(65) Prior Publication Data

US 2021/0316821 A1 Oct. 14, 2021

Related U.S. Application Data

(60) Provisional application No. 63/009,121, filed on Apr. 13, 2020.

(51) Int. Cl.
*B63B 17/00* (2006.01)
*B63H 25/02* (2006.01)
*B63H 25/52* (2006.01)

(52) U.S. Cl.
CPC ..... *B63B 17/00* (2013.01); *B63H 25/02* (2013.01); *B63H 25/52* (2013.01); *B63H 2025/022* (2013.01)

(58) Field of Classification Search
CPC .. B63B 17/00; B63H 25/02; B63H 2025/022; B63H 2025/024
See application file for complete search history.

(56) References Cited

U.S. PATENT DOCUMENTS 3,992,070 A * 11/1976 Dunn ..... B60K 37/00 292/DIG. 19
4,957,056 A * 9/1990 Martin ..... B63B 19/02 114/361
7,140,314 B2 * 11/2006 Kamio ..... B63B 34/10 440/2
7,490,571 B2 * 2/2009 Luxford ..... B63H 25/52 280/775
8,656,852 B1 * 2/2014 Jones ..... B63H 25/02 114/144 R
8,943,987 B2 * 2/2015 Jones ..... B63H 25/02 114/144 R

* cited by examiner

*Primary Examiner* — Ajay Vasudeva
(74) *Attorney, Agent, or Firm* — Brennan, Manna & Diamond, LLC

(57) ABSTRACT

An adjustable boat console movable between an operating position and a stowed position. The adjustable boat console comprises a housing comprising a back panel that will be positioned flush with a deck of a boat when the adjustable boat console is in the stowed position. The adjustable boat console further comprises a pivotal connecting component connecting the housing to the deck of the boat at a forward edge. The adjustable boat console further comprises an adjusting component. The adjusting component is configured to raise and retract the housing from the deck. A system for adjusting a boat console between an operating position and a stowed position is also disclosed.

13 Claims, 3 Drawing Sheets

ADJUSTABLE BOAT CONSOLE

CROSS-REFERENCE TO RELATED APPLICATION

The present application claims priority to, and the benefit of, U.S. Provisional Application No. 63/009,121, which was filed on Apr. 13, 2020 and is incorporated herein by reference in its entirety.

FIELD OF THE INVENTION

The present invention generally relates to an adjustable console for a boat, and more specifically to a boat console that folds down flush with the boat deck when not needed increasing the available usable deck space and removing potential obstructions during recreational boating activities. Accordingly, the present specification makes specific reference thereto. However, it is to be appreciated that aspects of the present invention are also equally amenable to other like applications, devices, and methods of manufacture.

BACKGROUND OF THE INVENTION

By way of background, a boat console is a structure located on a boat deck that houses a boat's controls, such as steering, ignition, trim control, radio, antennas, and other electronic devices, switches, etc. Typically, the steering console is a permanent fixture of a boat that cannot be moved, adjusted, or lowered. As boats, especially smaller ones, are limited in usable space, the steering console can be quite a hindrance. Most steering consoles on smaller boats are center mounted which significantly limits the usable deck space.

Not only do boat consoles interfere with casting while fishing, they reduce the overall amount of space available on deck for standing or relaxing. Fishermen are often forced to cast from the front or sides of the boat from awkward stances close to the water which can be less safe. Boating enthusiasts would benefit from additional usable space while on the water for fishing or other recreational activities.

Accordingly, there is a great need for a way to increase space on a boat deck. There is also a need for a boat console that is stowable out of the way when not in use. Similarly, there is a need for a boat console that folds down flush with the deck that increases usable deck space. Further, there is a need for a way to limit interference from a boat console while fishing or during other water recreation.

In this manner, the improved adjustable console of the present invention for a use with a boat accomplishes all of the forgoing objectives, thereby providing an easy solution for increasing usable deck space. A primary feature of the adjustable console is a stowable steering console. The present invention allows the console to fold down flush with the boat deck thereby increasing usable deck space. Finally, the improved adjustable boat console of the present invention is capable of ensuring that the steering console is not an obstacle for fishing enthusiasts and allows individuals to walk around or relax on deck more easily.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an adjustable boat console for use with a boat. The adjustable boat console is configured to move between an operating position and a stowed position. The adjustable boat console comprises a housing, a pivotal connecting component, and an adjusting component. The housing comprises a pair of sides, a back plate, and a control panel.

The housing is movably connected to a deck of the boat by the pivotal connecting component. The pivotal connecting component is a hinge or other similar moving joint that connects to the back of the housing allowing the housing to articulate. The housing is movable between an operating position and a stowed position by the adjusting component. The adjusting component is configured to raise and retract the housing. The back of the housing moves between a parallel orientation with the deck when retracted and an angled or perpendicular orientation when raised.

The adjustable boat console may further comprise a securing component. The securing component is configured to lock the housing in the stowed position. The adjustable boat console further comprises an adjusting component support member. The adjusting component support member is positioned between and is attached to the pair of sides of the housing. The adjusting component is attached at one end to the adjusting component support member and to the boat at the other end.

The adjusting component comprises an adjusting member. The adjusting member comprises a foot end and an adjusting end. The foot end is attached to the boat and the adjusting end attaches to the adjusting component support member. The adjusting end is configured to extend outward pushing against the adjusting component support member raising the housing from the deck. The adjusting end is also configured to retract inward pulling the adjusting component support member downward to lower the housing toward the deck.

The adjusting component may further comprise a second adjusting member. The second adjusting member comprises a foot end and an adjusting end. The foot end is attached to the boat and the adjusting end attaches to the adjusting component support member. The second adjusting end is configured to extend outward pushing against the adjusting component support member raising the housing from the deck in conjunction with the first adjusting member. The second adjusting end is also configured to retract inward pulling the adjusting component support member downward to lower the housing toward the deck in conjunction with the first adjusting member.

The subject matter disclosed and claimed herein, in another embodiment thereof, comprises a system for adjusting a boat console of a boat between an operating position and a stowed position. The system comprises a boat deck and an adjustable boat console. The boat deck comprises a central opening configured to accept the adjustable boat console. The adjustable boat console is pivotally connected to the deck along a forward edge of the central opening. The adjustable boat console is configured to move between an operating position and a stowed position.

The adjustable boat console comprises a housing, a pivotal connecting component, and an adjusting component. The housing comprises a pair of sides, a back plate, and a control panel. The back of the housing is movably connected to a deck by the pivotal connecting component. The pivotal connecting component is a hinge or other similar moving joint that connects to the back of the housing allowing the housing to articulate.

The housing is movable between an operating position and a stowed position by the adjusting component. The adjusting component is configured to raise and retract the housing. The back of the housing moves between a parallel orientation with the deck when retracted and an angled or perpendicular orientation when raised. When retracted, the housing is retained within the central opening with the back in line with the deck.

The adjustable boat console may further comprise a securing component. The securing component is configured to lock the housing in the stowed position. The adjustable boat console further comprises an adjusting component support member. The adjusting component support member is positioned between and is attached to the pair of sides of the housing. The adjusting component is attached at one end to the adjusting component support member and to the boat at the other end.

The adjusting component comprises an adjusting member. The adjusting member comprises a foot end and an adjusting end. The foot end is attached to the boat within the central opening and the adjusting end attaches to the adjusting component support member. The adjusting end is configured to extend outward pushing against the adjusting component support member raising the housing from the deck. The adjusting end is also configured to retract inward pulling the adjusting component support member downward to lower the housing toward the deck.

The adjusting component may further comprise a second adjusting member. The second adjusting member comprises a foot end and an adjusting end. The foot end is attached to the boat within the central opening and the adjusting end attaches to the adjusting component support member. The second adjusting end is configured to extend outward pushing against the adjusting component support member raising the housing from the deck in conjunction with the first adjusting member. The second adjusting end is also configured to retract inward pulling the adjusting component support member downward to lower the housing toward the deck in conjunction with the first adjusting member.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
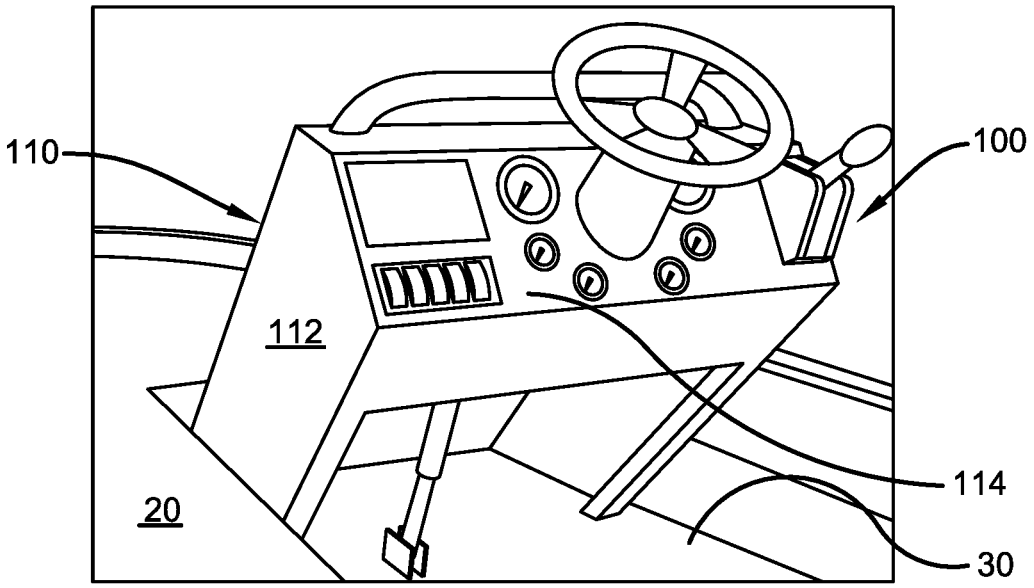
FIG. 1 illustrates a perspective view of an adjustable boat console of the present invention in an operating position in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention, in one exemplary embodiment, is a boat steering console. The boat steering console can be folded down approximately flush with the boat deck at the push of a button. The folded console eliminates the interference caused by the console when fishing from the boat. The invention creates approximately between nine and twelve or more additional square feet of fishing platform on a boat when in a stowed position.

The adjustable boat console is designed to create more space for fishing on a boat by enabling users to raise and lower the steering console as needed. The adjustable boat console is comprised of a control/steering console capable of folding or articulating completely flat and parallel to the boat deck, thereby creating more boat deck square footage for a user to stand on while fishing. The adjustable boat console is typically powered by a motor that articulates the control console up and down and may be button activated. The adjustable boat console may be made from an aluminum or fiberglass so that it is sturdy enough to walk on. It may be raised and lowered within a few seconds.

Figure 2:
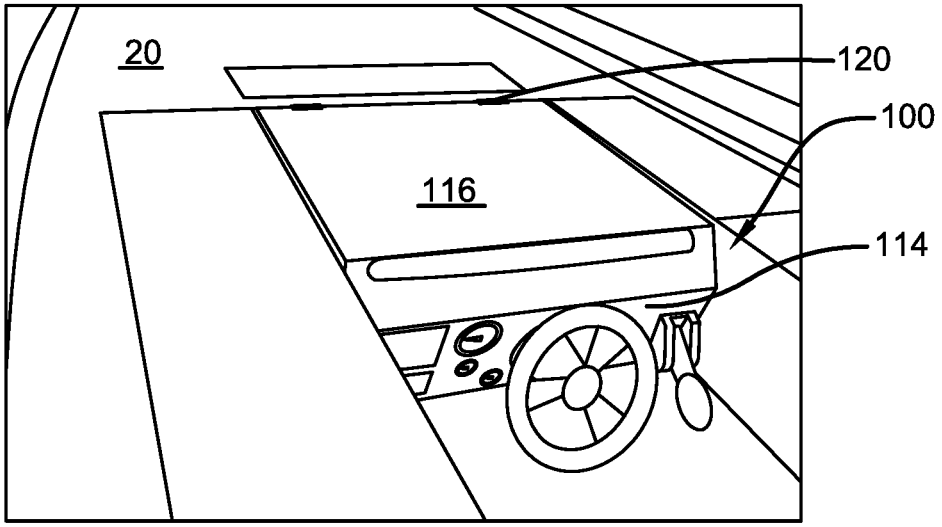
FIG. 2 illustrates a perspective view of an adjustable boat console of the present invention in a stowed position in accordance with the disclosed architecture.
Figure 3:
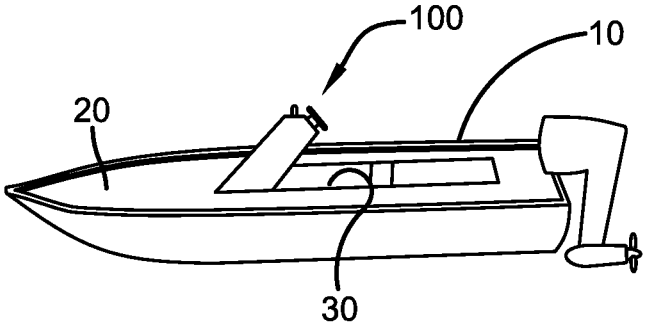
FIG. 3 illustrates a side view of the adjustable boat console of the present invention in the operating position in accordance with the disclosed architecture.
Figure 4:
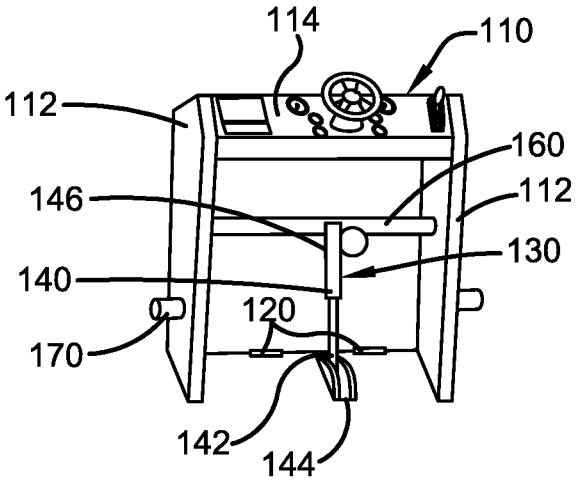
FIG. 4 illustrates a front view of the adjustable boat console of the present invention in the operating position in accordance with the disclosed architecture.
Figure 5:
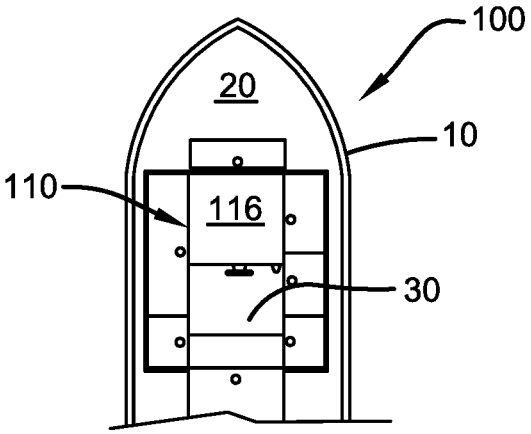
FIG. 5 illustrates an overhead view of the adjustable boat console of the present invention in the stowed position in accordance with the disclosed architecture.
Figure 6:
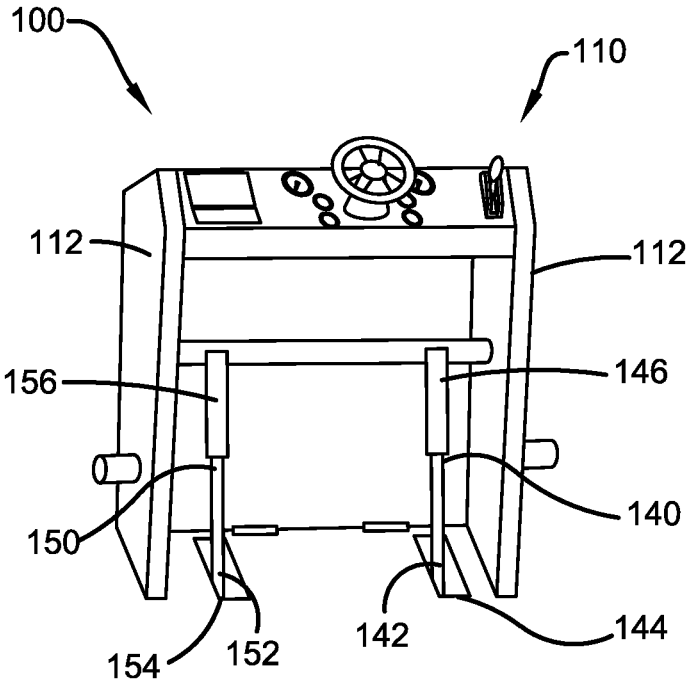
FIG. 6 illustrates a front perspective view of the adjustable boat console of the present invention in the operating position in accordance with the disclosed architecture.

Referring initially to the drawings, FIGS. 1-6 illustrate an adjustable boat console 100. The adjustable boat console 100 is configured for use with a boat 10. The adjustable boat console 100 is configured to move between an operating position, which is generally angled or upright as illustrated in FIGS. 1 and 3, and a stowed position which is generally folded down into an opening 30 in a deck 20 of the boat 10 as illustrated in FIGS. 2 and 5.

As illustrated in FIG. 4, the adjustable boat console 100 comprises a housing 110, a pivotal connecting component 120, and an adjusting component 130. The housing comprises a pair of sides 112, a back plate 116, and a control panel 114. The housing 110 may be manufactured from a sturdy material with the back plate 116 typically constructed to support between twenty and seven hundred pounds when in the stowed position. When in the stowed position, the back plate 116 adds to the usable deck space of the boat 10.

The housing 110 is movably connected to the deck 20 by the pivotal connecting component 120. The pivotal connecting component 120 is typically a hinge, piano hinge, or other similar movable joint that connects the deck 20 to the back plate 116 of the housing 110 along an edge of the opening 30. This connection allows the housing 110 to articulate along the joint so that the housing 110 is movable between the operating position and the stowed position when manipulated by the adjusting component 130.

The adjusting component 130 is configured to raise and retract the housing 110 out of the opening 30 away from the deck 20. The back plate 116 of the housing 110 moves between a generally parallel orientation with the deck 10 when retracted and an angled or perpendicular orientation when raised. As such, the back plate 116 is approximately flush with the deck 20 when the housing 110 is in the stowed position and is either angled or approximately perpendicular to the deck 20 when the housing 110 is in the operating position.

The adjustable boat console 100 may further comprise a securing component 170. The securing component 170 may be a pin, latch, or other locking mechanism configured to lock the housing 110 in place when in the stowed position. The adjustable boat console 100 further comprises an adjusting component support member 160. The adjusting component support member 160 is positioned between and is attached to the pair of sides 112 of the housing 110. The adjusting component support member 160 may be a crossbar or other similar horizontal connector spanning the pair of sides 112. The adjusting component 130 is attached at one end to the adjusting component support member 160 and to the boat 10 at the other end. The adjusting component 130 may be powered by a motor, battery, or other power source.

The adjustable boat console 100 may further comprise a securing strap (not shown). The securing strap is attachable to the adjusting component support member 160 with a multi-hole bracket (not shown) and is configured to help keep the housing 110 in an upright position. This is advantageous as it provides tension on the adjustable boat console 100 by triangulating the force for vibrations that occur when driving the boat 10.

The adjusting component 130 comprises an adjusting member 140. The adjusting member 140 comprises a foot end 142 and an adjusting end 146. The foot end 142 comprises an attachment element 144 for attaching the foot end 142 non-movably to the boat 10, typically somewhere within the opening 30. The adjusting end 146 attaches an adjusting member engaging connector 162 on the adjusting component support member 160.

The adjusting end 146 is configured to extend outward pushing against the adjusting component support member 160 raising the housing 110 from the deck 10. The adjusting end 146 is also configured to retract inward pulling the adjusting component support member 160 downward to lower the housing 110 toward the deck 10. The adjusting member 140 is typically a linear actuator. The linear actuator may be a hydraulic actuator, a pneumatic actuator, or an electro-mechanical actuator.

The adjusting component 130 may further comprise a second adjusting member 150. The second adjusting member 150 comprises a foot end 152 and an adjusting end 156. The foot end 152 comprises an attachment element 154 for attaching the foot end 152 non-movably to the boat 10, typically somewhere within the opening 30. The adjusting end 156 attaches an adjusting member engaging connector 162 on the adjusting component support member 160.

The adjusting end 156 is configured to extend outward pushing against the adjusting component support member 160 raising the housing 110 from the deck 10 in conjunction with the first adjusting member 140. The adjusting end 156 is also configured to retract inward pulling the adjusting component support member 160 downward to lower the housing 110 toward the deck 10 in conjunction with the first adjusting member 140. The second adjusting member 150 is typically a linear actuator. The linear actuator may be a hydraulic actuator, a pneumatic actuator, or an electro-mechanical actuator.

Figure 7:
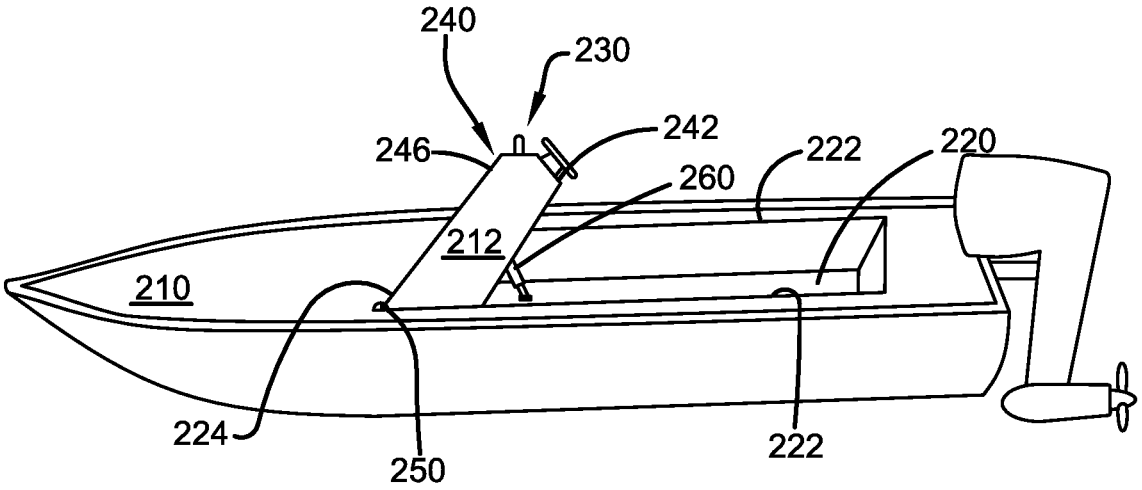
FIG. 7 illustrates a perspective view of a system for adjusting a boat console between an operating position and a stowed position of the present invention in accordance with the disclosed architecture.

The subject matter disclosed and claimed herein, in an additional embodiment thereof as illustrated in FIG. 7, comprises a system 200 for adjusting a boat console of a boat between an operating position and a stowed position. The system 200 comprises a boat deck 210 and an adjustable boat console 230. The boat deck 210 comprises a central opening 220 comprising a pair of sides 220 and a forward edge 224 configured to accept and partially encapsulate the adjustable boat console 230. The adjustable boat console 230 is pivotally connected to the deck 210 along the forward edge 224 of the central opening 220. The adjustable boat console 230 is configured to move between the operating position, which is generally angled or upright and the stowed position which is generally folded down into the opening 220.

The adjustable boat console 230 comprises a housing 240, a pivotal connecting component 250, and an adjusting component 260. The housing 240 comprises a pair of sides 242, a back plate 246, and a control panel 244. The back plate 246 of the housing 240 is movably connected to a deck 210 by the pivotal connecting component 250. The pivotal connecting component 250 is typically a hinge or other similar movable joint that connects the deck 220 to the back plate 246 of the housing 240 along the forward edge 224 of the opening 220. This connection allows the housing 240 to articulate along the joint so that the housing 240 is movable between the operating position and the stowed position when manipulated by the adjusting component 260.

The housing 240 is movable between the operating position and the stowed position by the adjusting component 260. The back plate 246 of the housing 240 moves between a parallel orientation with the deck 210 when retracted and an angled or perpendicular orientation when raised. As such, the back plate 246 is approximately flush with the deck 210 when the housing 240 is in the stowed position and is either angled or approximately perpendicular to the deck 210 when the housing 240 is in the operating position.

The adjustable boat console 230 may further comprise a securing component (similar to 170). The securing component may be a pin, latch, or other locking mechanism configured to lock the housing 240 in place when in the stowed position. The adjustable boat console 230 further comprises an adjusting component support member (similar to 160). The adjusting component support member is positioned between and is attached to the pair of sides 242 of the housing 240. The adjusting component support member may be a crossbar or other similar horizontal connector spanning the pair of sides 242. The adjusting component 260 is attached at one end to the adjusting component support member and to the boat 10 at the other end. The adjusting component 260 may be powered by a motor, battery, or other power source.

The adjusting component 260 comprises an adjusting member (similar to 140). The adjusting member comprises a foot end (similar to 142) and an adjusting end (similar to 146). The foot end comprises an attachment element (similar to 144) for attaching the foot end non-movably to the boat 10, typically somewhere within the opening 220. The adjusting end attaches an adjusting member engaging connector (similar to 162) on the adjusting component support member.

The adjusting end is configured to extend outward pushing against the adjusting component support member raising the housing 240 from the deck 210. The adjusting end is also configured to retract inward pulling the adjusting component support member downward to lower the housing 240 toward the deck 210. The adjusting member is typically a linear actuator. The linear actuator may be a hydraulic actuator, a pneumatic actuator, or an electro-mechanical actuator.

The adjusting component 260 may further comprise a second adjusting member (similar to 150). The second adjusting member comprises a foot end (similar to 152) and an adjusting end (similar to 156). The foot end comprises an attachment element (similar to 154) for attaching the foot end non-movably to the boat 10, typically somewhere within the opening 220. The adjusting end attaches an adjusting member engaging connector on the adjusting component support member.

The adjusting end is configured to extend outward pushing against the adjusting component support member raising the housing 240 from the deck 210 in conjunction with the first adjusting member. The adjusting end is also configured to retract inward pulling the adjusting component support member downward to lower the housing 240 toward the deck 210 in conjunction with the first adjusting member. The second adjusting member is typically also a linear actuator. The linear actuator may be a hydraulic actuator, a pneumatic actuator, or an electro-mechanical actuator.

Notwithstanding the forgoing, the adjustable boat console 100 and system 200 can be any suitable size, shape, and configuration as is known in the art without affecting the overall concept of the invention, provided that it accomplishes the above stated objectives. One of ordinary skill in the art will appreciate that the shape and size of the adjustable boat console 100 and system 200 and their various components, as show in the FIGS. are for illustrative purposes only, and that many other shapes and sizes of the adjustable boat console 100 and system 200 are well within the scope of the present disclosure. Although dimensions of the adjustable boat console 100 and system 200 and their components (i.e., length, width, and height) are important design parameters for good performance, the adjustable boat console 100 and system 200 and their various components may be any shape or size that ensures optimal performance during use and/or that suits user need and/or preference. As such, the adjustable boat console 100 and system 200 may be comprised of sizing/shaping that is appropriate and specific in regard to whatever the adjustable boat console 100 and system 200 is designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An adjustable boat console comprising:

a housing comprising a pair of sides, a back plate, and a control panel;

a pivotal connecting component movably connecting the housing to a deck of a boat;

an adjusting component configured to raise and retract the housing;

an adjusting component support member horizontally disposed between and connecting the pair of sides of the housing; and wherein the housing is movable between an operating position and a stowed position; and wherein the adjusting component comprises an adjusting member comprising a foot end and an adjusting end; and wherein the adjusting end of the adjusting member is attached to the adjusting component support member and the foot end of the adjusting member comprises an attachment element for securing the adjusting member to the boat.

2. The adjustable boat console of claim 1, wherein the back plate is flush with the deck when the housing is in the stowed position.

3. The adjustable boat console of claim 1, wherein the back plate is angled with respect to the deck when the housing is in the operating position.

4. The adjustable boat console of claim 1, wherein the pivotal connecting component is a hinge.

5. The adjustable boat console of claim 1, wherein the back plate is constructed to support at least two hundred pounds.

6. The adjustable boat console of claim 1, wherein the adjusting member is a linear actuator.

7. The adjustable boat console of claim 1, wherein the adjusting member is a hydraulic actuator.

8. The adjustable boat console of claim 1, wherein the adjusting member is a pneumatic actuator.

9. The adjustable boat console of claim 1, wherein the adjusting member is an electro-mechanical actuator.

10. The adjustable boat console of claim 1 further comprising a securing component for locking the housing in the stowed position.

11. An adjustable boat console comprising:

a housing comprising a pair of sides, a back plate, and a control panel;

a pivotal connecting component movably connecting the housing to a deck of a boat;

an adjusting component support member horizontally disposed between and connecting the pair of sides of the housing;

an adjusting component comprising a first adjusting member and a second adjusting member both attached to the adjusting component support member and configured to raise and retract the housing; and wherein each of the first and second adjusting members comprise a foot end and an adjusting end; and wherein the adjusting end of each of the first and second adjusting members is attached to the adjusting component support member and the foot end of each of the first and second adjusting members comprises an attachment element for securing the adjusting member to the boat; and wherein the housing is movable between an operating position and a stowed position.

12. The adjustable boat console of claim 11 further comprising a securing component for locking the housing in the stowed position.

13. A system for adjusting a boat console of a boat between an operating position and a stowed position comprising:

a boat deck comprising a central opening; and an adjustable boat console pivotally connected to the deck along a forward edge of the central opening, the adjustable boat console comprising:

a housing comprising a pair of sides, a back plate, and a control panel;

a pivotal connecting component connecting the housing to the deck of the boat;

an adjusting component support member horizontally disposed between and connecting the pair of sides of the housing; and an adjusting component configured to raise and retract the housing from the deck; and wherein the housing is movable between the operating position and the stowed position within the central opening; and wherein the adjusting component comprises an adjusting member comprising a foot end and an adjusting end; and wherein the adjusting end of the adjusting member is attached to the adjusting component support member and the foot end of the adjusting member comprises an attachment element for securing the adjusting member to the boat within the central opening.

* * * * *